US006114619A

United States Patent [19]

Thompson

[11] Patent Number: 6,114,619

[45] Date of Patent: Sep. 5, 2000

[54] VENTILATED MUTE FOR WIND INSTRUMENT

[76] Inventor: Robert Shawn Thompson, 15369 68th Ave. N., Maple Grove, Minn. 55311-3252

[21] Appl. No.: 09/115,890

[22] Filed: Jul. 15, 1998

[51] Int. Cl.[7] ..... G10D 9/06

[52] U.S. Cl. ..... 84/400; 84/453

[58] Field of Search ..... 84/400, 453; 181/185, 181/196

[56] References Cited

U.S. PATENT DOCUMENTS 3,392,619 7/1968 Hill ..... 84/400

5,309,808 5/1994 Tarrant ..... 84/400

*Primary Examiner*—Brian Sircus

*Assistant Examiner*—Marlon T. Fletcher

[57] ABSTRACT

Disclosed is a mute that attaches over the bell of a wind instrument which can be used for practice or performance. The shell of this mute consists of a symmetrically shaped cylindrical plastic jar. Attached to the exterior of the mute shell is an illuminated ON-OFF switch that is connected to a 12 VDC blower fan motor and a 12 V AC adapter. The 12 VDC blower motor inlet is attached to a plastic inlet duct contained in the mute shell. The blower motor vent is attached to a plastic egress duct which exits the mute shell. The ventilation system is encompassed by acoustical foam. This mute muffles the sound of a wind instrument without altering its pitch or timbre, and without creating any additional pressure at the players lips.

11 Claims, 2 Drawing Sheets

VENTILATED MUTE FOR WIND INSTRUMENT

BACKGROUND OF THE INVENTION

A mute is used to lower the decibel level of a wind instrument or to modify its sound characteristics. Prior mutes have been known to generate undesirable pressure at the players lips. The purpose of this invention is to muffle the sound of a wind instrument for practicing or performing without creating any additional pressure at the players lips. This mute differs from prior art by utilizing an electric motor fan ventilation system to eliminate the problem of restricted air flow.

The shell of this mute was originally constructed out of a plastic jar which was used for food additives. The threaded rim portion of the jar has been removed and the bell of a wind instrument is inserted therein. The dimensions and appearance of the mute shell can be modified for various wind instruments, or for production reasons without departing from the concept of the invention. The single wall exterior shell of this mute differs greatly from the double wall shell practiced in U.S. Pat. No. 3,555,956. This mute utilizes a cylindrical plastic container for its exterior shell which differs greatly from the conical structure of U.S. Pat. No. 5,488,893, U.S. Pat. No. 5,309,808, U.S. Pat. No. 4,273,022 or U.S. Pat. No. 4,273,021. The mute is held firmly on the wind instrument by the bell of the instrument which presses against the acoustical foam in the mute and against the inner rim of the mute shell towards the player. The method used to attach this mute to a wind instrument differs greatly from U.S. Pat. No. 3,429,215 and U.S. Pat. No. 2,571,809 because this mute fits over the bell of a wind instrument which eliminates the need for mounting clips thus providing a more secure installation.

BRIEF SUMMARY OF THE INVENTION

This mute consists of a cylindrical plastic jar with a symmetrical shape used for the mute shell which contains a 12 VDC blower fan connected to a plastic inlet duct and a plastic egress duct. The 12 VDC blower fan is connected to a 12 V AC adapter. The fan motor is controlled by an illuminated ON-OFF switch which is mounted on the exterior of the mute. The cavity of the mute is filled with sound absorbing acoustical foam.

This configuration of component parts embodies a mute which does not alter the pitch or timbre of a wind instrument. This mute is lightweight, mounts easily and securely to a wind instrument bell, and can be manufactured at a reasonable cost. The ventilation system of this mute produces a more efficient air flow through the wind instrument than prior art. The smoother air flow of this mute enables the player to play for longer periods of time because the lungs and the muscles of the face are placed under much less strain than prior art. This mute muffles the sound of a wind instrument for practicing or for performing under conditions where low sound levels are required.

DETAILED DESCRIPTION OF THE INVENTION

Figure 1:
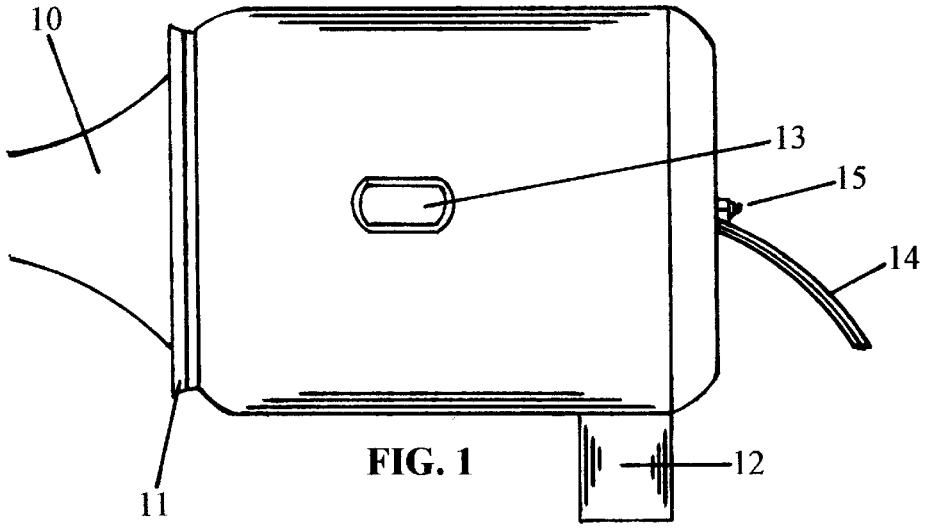
FIG. 1 is a lateral elevational view of the mute attached to the bell of a wind instrument; in this instance, a trumpet in the operative position.

In FIG. 1 the mute is shown in the operative position. Reference point 10 is the bell of a trumpet, although the mute is adaptable to a variety of other wind instruments without departing from the concept of the invention, The trumpet is inserted at approximately a 30 degree angle into the flexible mouth of the plastic container, Point 11. The mute is held firmly in place, (in line with the trumpet), by the bell of the trumpet which presses against the acoustical foam in the mute and against the inner rim of the mute shell towards the player. Point 12 depicts the egress air duct extending downward. Point 13 is the illuminated ON-OFF switch (SPST contacts rated at 30A at 12 VDC). The Amp. and Voltage rating of the switch could be altered contingent upon the Amp. and Voltage requirements of the motor utilized without departing from the concept of the invention. The illumination of the switch is necessary as a reminder that the motor is in use because the (ball bearing brushless DC blower) motor is very quiet and is further silenced by its location within the mute. Point 14 is the wiring, leading from the switch and the motor to a power supply. The mute can be powered by an AC adapter (as illustrated at Point 24, FIG. 6), or by a battery contained inside the mute, or mounted on the exterior of the mute shell. The mute could also be powered by a rechargeable battery power pack to be attached to the wind instrument, or on a belt clip to be worn by the player. Point 15 is the 2"×10/32" screw, washer and nut assembly, (1 of 2), which fasten the ventilation system to the mute shell.

Figure 2:
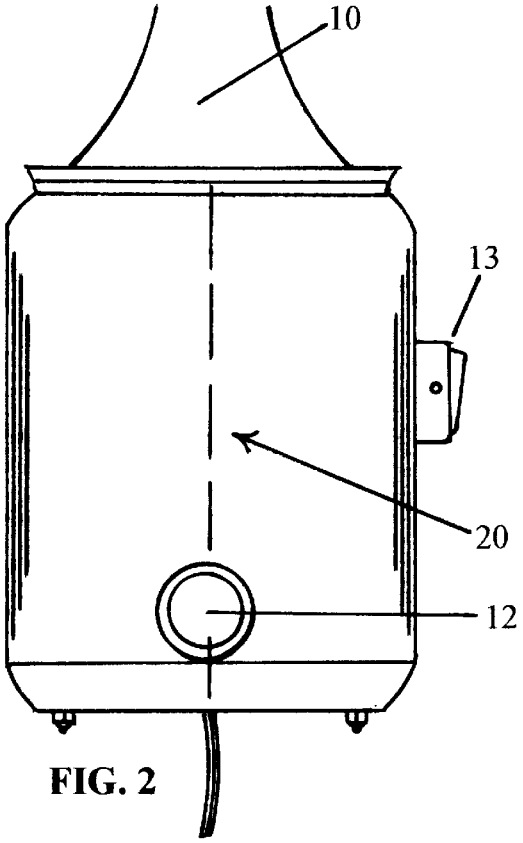
FIG. 2 is a lateral elevational view of the mute attached to the bell of a wind instrument; in this instance, a trumpet in a vertical position.

FIG. 2 shows the mute attached to a wind instrument bell, Point 10, in this instance a trumpet in a vertical position. Point 13 is the illuminated ON-OFF switch. The opening of the egress air duct, Point 12 is shown, the dimensions of which are ¾" I.D. & 1⅛" O.D. The dimensions of the plastic jar for a trumpet as shown are 6¼" High X 5" Wide. The width of the opening of the mouth of the jar is 4⅛". The dimensions given here are for trumpet and will vary contingent upon the type of wind instrument for which the mute is constructed, or for manufacturing reasons, without departing from the concept of the invention.

Figure 3:
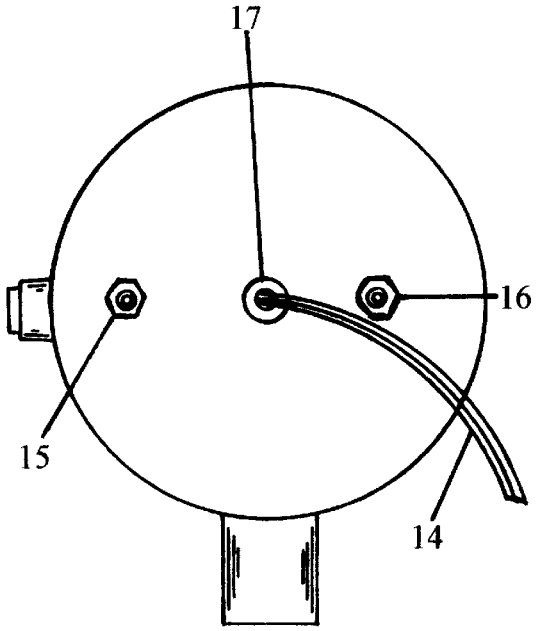
FIG. 3 is a plan view of the forward end of the mute.

FIG. 3 shows the front end of the mute and illustrates the location of the 2"×10/32" screws, washers and nuts, Points 15 and 16, used for mounting the ventilation system to the plastic jar. Point 17 is a rubber grommet (⅜" O.D. & ⅛" I.D.) used to protect the wires, Point 14, from abrasion as they exit the mute shell.

Figure 4:
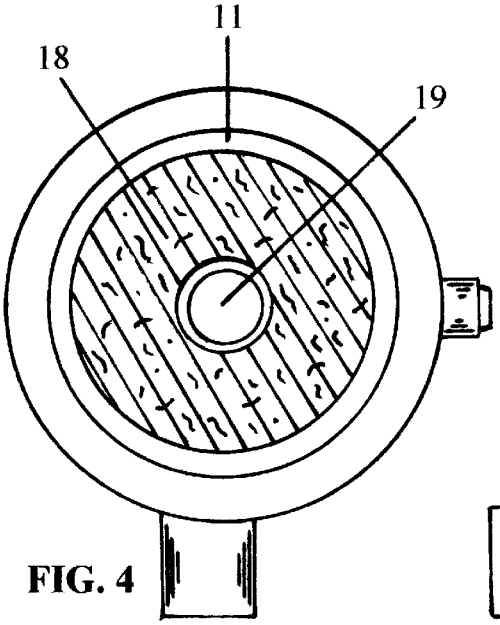
FIG. 4 is a plan view of the back end of the mute showing the opening for attaching the mute to a wind instrument bell.

FIG. 4 is a plan view of the back end of the mute showing the flexible rim of the jar, Point 11, which is the opening for attaching the mute to the bell of a wind instrument. When in use the top layer of the acoustical foam filling, Point 18, presses against the wind instrument bell and holds it securely against the inner rim of the mute shell. The air intake duct, Point 19, is illustrated in the center of the cut out acoustical foam. The intake port measures (¾" I.D. & 1⅛" O.D.). The top of the intake duct is flush with the top layer of acoustical foam. The plastic used to construct the mute shell, intake duct, and egress duct is acoustically dead, as is taught by Martin in U.S. Pat. No. 3,555,956. The intake air duct pulls the balance of the sound, the portion which is not absorbed by the foam, away from the bell thus eliminating the occurrence of sound reflecting back to the bell. This configuration keeps the pitch and timbre consistent and unwavering.

Figure 5:
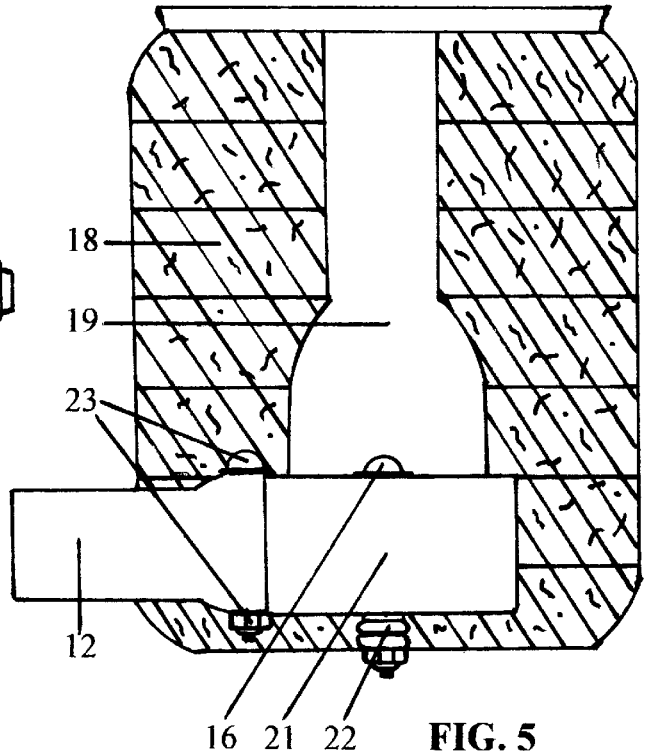
FIG. 5 is a lateral sectional view of the mute taken from reference Point 20, FIG. 2, illustrating the ventilation ducts, flexible motor mount, and acoustical foam filling.

FIG. 5 is a lateral sectional view of the mute taken from Point 20, (FIG. 2), showing the ventilation system and the acoustical foam surrounding it. The layers of acoustical foam, Point 18, are cut out in the center to encompass the ventilation system. The foam arrangement could be modified if needed to adjust the mutes decibel level, or for manufacturing reasons without departing from the concept of the invention. The plastic air intake duct, Point 19, is 4¼" in length. The flared end of the intake duct which encompasses the inlet of the blower motor has a diameter of 2¼". The air intake duct has two mounting tabs which coincide with the existing holes on the blower motor case, Point 21. The air intake duct is attached to the motor case with two 2"×10/32" screws and washers, Point 15 (FIG. 3) and Point 16. The screws extend through the motor case, then one 10/32" nut is used on each screw to fasten the duct to the motor case, next two rubber grommets (⅜" O.D.& ⅛" I.D.), Point 22, are put on each screw. The rubber grommets are used to eliminate vibration transfer from the motor to the mute shell. The grommets also provide elasticity of the ventilation system while the wind instrument bell is being pressed into the flexible mouth of the plastic mute shell. The two 2"×10/32" screws extend through corresponding holes in the base of the mute shell and are fastened with washers and nuts. The plastic egress air vent, Point 12, is 2½" in length. The flared end of the egress duct which encompasses the blower motor air outlet is 1½" in diameter. The plastic egress air duct has a hole in it which coincides with a hole that is drilled through the blower motor case. The duct is attached to the blower motor case outlet with a 1½"×10/32" screw, washer and nut, Point 23. A plastic bushing is used inside the blower motor outlet, the screw extends through the bushing which supports the blower motor case to prevent distortion of the case and subsequent motor damage. The egress air duct exits through a 1⅛" hole which is drilled through the side of the jar and extends outward 1⅜". An alternative fan motor and duct configuration could be utilized without departing from the concept of the invention.

Figure 6:
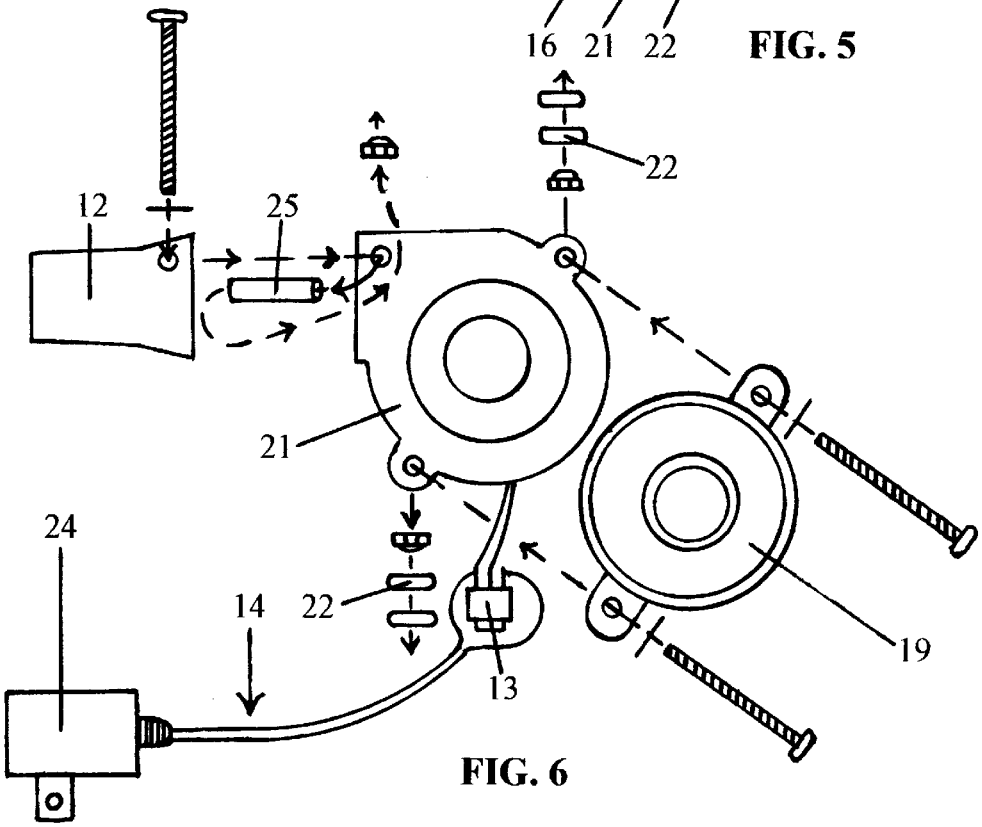
FIG. 6 is an exploded view of the ventilation system including the intake and egress duct, DC blower motor, flexible motor mounts, and switch assembly.

FIG. 6 is an exploded view of the ventilation system. This drawing shows the method of attachment of the intake duct with mounting tabs (Point 19) and egress duct (Point 12) to the brushless 12 VDC blower motor (Point 21). Reference point 13 depicts the illuminated rocker switch (SPST Contacts Rated at 30A at 12 VDC) and the wiring (Point 14) which leads to a power source, in this instance a 12 V AC adapter (Point 24, with 10' minimum cord length). Point 25 illustrates the plastic bushing used to support the blower motor case, to prevent distortion of the case when the egress duct is attached. Duct tape is used to seal the seams between the motor and each duct. The two reference Points 22 are the grommets used to provide flexibility of the ventilation system during wind instrument attachment and to eliminate vibration transfer from the motor to the mute shell. The brushless DC (ball bearing) blower motor is a readily available fan motor normally utilized to cool circuitry or electronic parts which are subject to heating. The type of motor and the duct configuration utilized for this mute could be altered without departing from the concept invention.

I claim:

1. A wind instrument mute comprising a shell which attaches over a bell of a wind instrument which utilizes an electric motor to generate forced air ventilation for the purpose of eliminating back pressure in a wind instrument.

2. The mute as set forth in claim 1, in which the electric motor is controlled by an ON-OFF switch.

3. The mute as set forth in claim 2, in which the ON-OFF switch utilized is an illuminated ON-OFF switch.

4. The mute as set forth in claim 1, in which the electric motor utilized is an electric fan motor.

5. The mute as set forth in claim 4, in which the electric fan motor utilized is a brushless 12 VDC blower motor.

6. The mute as set forth in claim 4, in which the electric fan motor is attached to ventilation ducts which draw air from the bell of said wind instrument and expel air from the mute in order to eliminate back pressure as felt at a mouthpiece by a player of the wind instrument.

7. The mute as set forth in claim 6, in which the electric fan motor and said ventilation ducts are employed to eliminate back pressure as felt by the players lips at the mouthpiece.

8. The mute as set forth in claim 6, in which the electric fan motor and the said ventilation ducts are contained inside a flexible jar which serves as the mute shell.

9. The mute as set forth in claim 8, wherein the mute shell has a cylindrical side wall and a rounded base and a pliable flared opening which fully encloses the bell of the wind instrument which creates a seal between the mute and the wind instrument bell.

10. The mute as set forth in claim 9 in which the mute seals itself to the bell of the wind instrument by torsion created between acoustical foam contained in the mute and the opening of the mute shell because of the pliability of the acoustical foam.

11. The mute as set forth in claim 4, in which the electric fan motor utilized is a DC motor.

* * * * *